US005249416A

United States Patent [19]

Adams et al.

[11] Patent Number: 5,249,416

[45] Date of Patent: Oct. 5, 1993

[54] CIGARETTE PACKAGING MACHINE AND APPARATUS

[75] Inventors: John M. Adams, Mechanicsville, Va.; Angel Amendola, Millersville, Md.; Frederick M. Della Crosse, White Plains, N.Y.; Robert Gallino, Englewood Cliffs, N.J.; Jeffrey M. S. Haskins, Hanover; David Moir, Annapolis, both of Md.; Xuan M. Pham, Richmond, Va.; Kenneth B. Shepard, Chesterfield, Va.; Ronald R. Stewart, Gloucester,, Va.

[73] Assignee: Philip Morris Products Inc., Richmond, Va.

[21] Appl. No.: 3,846

[22] Filed: Jan. 11, 1993

Related U.S. Application Data

[63] Continuation of Ser. No. 700,759, May 15, 1991, abandoned.

[51] Int. Cl.[5] ..... B65B 19/22; B65B 51/32

[52] U.S. Cl. ..... 53/463; 53/371.2; 53/372.3; 53/234; 53/575

[58] Field of Search ..... 53/234, 148, 575, 463, 53/371.2, 371.3, 372.3; 156/583.91

[56] References Cited

U.S. PATENT DOCUMENTS

| | | | |
|---|---|---|---|
| 2,152,323 | 3/1939 | Moore | 53/463 X |
| 2,176,584 | 10/1939 | Daller | 53/463 X |
| 2,196,666 | 4/1940 | Moore | 53/575 X |
| 2,480,501 | 8/1949 | Moore | 53/463 |
| 2,638,724 | 5/1953 | Harvey | 53/371.2 |
| 2,697,474 | 12/1954 | McGinley | 53/371.3 |
| 3,501,023 | 3/1970 | Seragnoli . | |
| 3,508,381 | 4/1970 | Seragnoli | 53/387.2 |
| 3,559,617 | 2/1971 | Seragnoli . | |
| 3,628,309 | 12/1971 | Seragnoli | 53/234 X |
| 3,899,863 | 8/1975 | Seragnoli et al. | 53/53 |
| 3,947,017 | 3/1976 | Seragnoli | 271/99 |
| 3,948,115 | 4/1976 | Seragnoli | 53/234 X |
| 3,982,380 | 9/1976 | Seragnoli | 53/77 |
| 3,987,753 | 10/1976 | Seragnoli | 118/212 |
| 4,154,438 | 5/1979 | Seragnoli | 271/12 |
| 4,175,456 | 11/1979 | Seragnoli | 83/176 |
| 4,208,854 | 6/1980 | Seragnoli | 53/575 |
| 4,548,019 | 10/1985 | Kruse | 53/234 X |
| 4,923,560 | 5/1990 | Inselmann | 156/583.91 |
| 5,048,260 | 9/1991 | Raymond | 53/371.3 X |

FOREIGN PATENT DOCUMENTS

| | | |
|---|---|---|
| 3836057A1 | 7/1989 | Fed. Rep. of Germany . |
| 675280 | 7/1959 | United Kingdom . |
| 2045678 | 11/1980 | United Kingdom . |

OTHER PUBLICATIONS

Korber AG & H. B. Fuller GmbH, "Anordnung Zum Verpacken von Zigaretten oder ahnlichen stabformugen Gegenstanden", 2244 Research Disclosure, No. 311 (Mar. 1990) translation provided.

*Primary Examiner*—James F. Coan
*Attorney, Agent, or Firm*—Mitchell P. Brook

[57] ABSTRACT

Cigarette packaging apparatus and method utilizing packaging stock comprising a pre-applied adhesive to form cigarette packages that are sealed by activating and then preferably setting the pre-applied adhesive.

10 Claims, 4 Drawing Sheets

CIGARETTE PACKAGING MACHINE AND APPARATUS

CROSS REFERENCE TO RELATED APPLICATION

This application is a continuation of copending U.S. patent application Ser. No. 07/700,759, filed May 15, 1991, and now abandoned.

BACKGROUND OF THE INVENTION

The present invention relates to an apparatus and method for packing cigarettes into cigarette packages sealed with pre-applied adhesives. More particularly, the present invention relates to manufacturing cigarette packages in which the packaging stock (such as pack labels) is coated with adhesive before it is supplied to the packaging machine and the machine provides means for activating the adhesive, and preferably setting the adhesive after it has been activated. Known wet-glue packaging machines may be modified to practice the present invention by removing or disabling the wet-glue application apparatus and adding apparatus as required to activate and set the pre-applied adhesive.

Cigarette packing machines are widely used in high speed cigarette manufacturing operations. In a typical commercial wet adhesive ("wet-glue") packing machine, cigarettes pass through successive processing steps to be formed into packs. Two types of machines are widely used—turret-type wet-glue machines and mandrel-type wet-glue machines. Water or other solvent based or wax based adhesives commonly are used. A typical soft cigarette pack manufactured by such machines comprises an internal liner, an external label, which typically is made of coated paper, and a closure stamp.

In general, turret-type wet-glue packing machines can be used to form a soft cigarette packs in several steps. First, a bundle of cigarettes, typically 20 in number, is formed. The cigarette bundle then passes among a number of processing turrets to form a pack. In this processing, a foil coated paper liner ("foil liner") is wrapped around the bundle and its ends are folded. Then, a label is wrapped around the bundle, and the portion corresponding to the bottom of the bundle is folded. The labels may be supplied to the machine on spools, or in pre-cut stacks. If spools are used, then the packing machine generally will include apparatus to cut individual labels as the spool is unwound. Before a label is wrapped around a bundle, wet glue is applied to the label. Typically the glue is applied at an edge corresponding to the sideseam of a cigarette pack and at another edge, corresponding to the folded over bottom of the pack. The wet glue is set after the label is wrapped around the bundle by holding it in place until the wet-glue has dried; heat may be applied to accelerate drying.

Turret wet-glue cigarette packers are widely known and exemplary versions are described in U.S. Pat. Nos. 3,628,309 and 3,948,115, both of which are assigned to G. D. Societa per Azioni, Via Pomponia 10, 40100 Bologna, Italy, which also sells commercial turret-type wet-glue packers under various model designations, including GDX-1 and GDX-500. U.S. Pat. No. 3,848,115 is incorporated herein in its entirety by reference. The GDX-1, which is generally described in U.S. Pat. No. 3,948,115, is used for illustrative purposes in the description of the present invention that follows.

The GDX-1 incorporates apparatus for the application of glue to the labels comprising a glue dauber assembly, glue roller, scraper assembly, glue pot, glue fill assembly and glue pot sensor. The GDX-1 also incorporates four processing turrets. In operation, the cigarette bundles are passed from turret to turret, each turret performing predetermined processing functions. The fourth turret functions to finish the folds on the bottom of the label in conjunction with an insertion finger (also called a "leaf spring") and then to set the glue on the bottom panel by operating in conjunction with a generally flat and semi-circular heating assembly. The generally flat face of the heating assembly has a flat raised portion that is designed to contact the pack bottoms and thereby set the glue by application of heat and pressure. In addition, the GDX-1 packer incorporates an exit ramp, which the wrapped cigarette bundles enter after the fourth processing turret. The exit ramp comprises a heater and pressure plate, which operate in conjunction to set the sideseam glue.

Mandrel-type wet-glue packing machines generally differ from turret-type machines as follows: The foil liner and label are wrapped around a hollow mandrel and the bottom of the foil liner and label are folded; the cigarettes are inserted into the hollow center of the mandrel; the cigarettes and packaging components are removed from the mandrel and the top folds are made; the pack is then transferred to a heating belt where the pack is subjected to heat, which may aid in drying the wet glue.

Wet-glue packaging machines possess a number of known disadvantages. One such disadvantage is slippage. Slippage occurs when opposing portions of the packaging stock, which are supposed to be sealed in a predetermined alignment, move with respect to each other before the wet glue is set such that the desired alignment is not achieved. As packers are operated at higher speeds, the occurrence of slippage tends to increase. Slippage therefore is undesirable because when it occurs, the resulting packs may be improperly sealed (impairing the shelf-life of the cigarettes contained and impairing the ability of the label to hold the packs together), the seals may not be properly registered; the label may be wrinkled or scalloped and the labels may have a sloppy or otherwise displeasing appearance.

Clogging is another known disadvantage of wet-glue packaging machines. Clogging occurs when the apparatus used to apply the wet glue to the packaging stock becomes blocked. Clogging also occurs as wet-glue is transferred from the glue application apparatus to downstream processing apparatus, thereby causing the downstream processing apparatus to become clogged. When clogging occurs, the machine must be stopped and cleaned by an operator—resulting in productivity loss.

Smearing is a further known disadvantage of wet-glue packaging machines. Smearing occurs, by way of example, when glue seeps out from glued seams, when it bleeds through the stock, when it smears and when it slings. Smeared packages can have a dirty and otherwise undesirable appearance.

Yet another disadvantage of wet-glue packaging machines is due to product loss from machine stoppages. As with many complex machines, wet-glue machines often are stopped. Machines may be stopped, for example, for de-clogging or other maintenance, re-supply and personnel changes. Manufacturing runs often may continue uninterrupted for less than 5–15 minutes. Each time a wet-glue machine is stopped, product may be lost because the glue that has been applied to packaging stock that are in processing dries during the stoppage. In both turret-type and mandrel type of wet-glue packers, packs can be lost on the heated exit apparatus. For example, when a typical turret-type wet-glue packer stops, the heating plate on the exit ramp stays hot. Thus, when the packer stops, the packs on the exit ramp can be degraded or burned.

A further disadvantage of wet-glue packaging machines is a lack of flexibility regarding the placement of adhesive. In the wet-glue machines, glue is applied with the glue daubers. The packaging stock is directed to the glue daubers by guides. The glue placement by the daubers must avoid the guides. In addition, the processing apparatus must be constructed such that mechanical elements downstream of where the glue is applied do not contact the wet glue.

Still further disadvantages of wet-glue packaging machines are difficulty in controlling the amount of glue that is applied, high viscosity of the glue itself, glue build-up along guides and frequent maintenance required by the glue application apparatus.

SUMMARY OF THE INVENTION

The present invention alleviates to a great extent the disadvantages of the prior art by providing cigarette packaging machines and methods which utilize packaging stock comprising a pre-applied adhesive to form cigarette packages that are sealed by activating the pre-applied adhesive. In the turret-type soft cigarette packer embodiment of the present invention (an embodiment that will be used for illustrative purposes throughout this application), packs are formed by wrapping pack labels having a pre-applied adhesive around a liner-wrapped cigarette bundle and then sealing the pack by activating the pre-applied adhesive, such as through the application of heat, and setting the adhesive, such as by cooling below the activation temperature.

The packaging apparatus of the present invention may incorporate any processing apparatus that forms packaging stock-wrapped cigarette bundles. Specifically in the case of modified turret-type soft pack machines, any processing apparatus that performs the steps of forming cigarette bundles, wrapping liners and pack labels around the bundles and folding the ends of the liners and the pack labels can be used. In the preferred modified turret-type embodiment, a modified GDX-1 wet-glue packer is used to perform these steps. The modifications include elimination or disabling of apparatus for handling and applying wet glue and addition of and modification of apparatus for activating and setting pre-applied adhesive.

More particularly, in a GDX-1 that is modified to reflect an embodiment of the present invention, the adhesive that is pre-applied to the label is activated through the application of heat at the fourth processing turret ("the activation turret") and the exit ramp (assuming a heat activated adhesive is selected). The fourth processing turret acts in the conventional fashion to fold portions of the label bottoms. Then the pre-applied adhesive on the bottom is activated as it enters an activating zone, which comprises a portion of the arc covered by the turret, such as an arc of between about 90° and 170°. In the activating zone, the bottom of the wrapped bundle contacts a heating element in the conventional reciprocating indexed fashion. It is preferred that the heating element be modified to achieve better results: for example, instead of the flat continuous raised contact portion, the heating element may comprise a number of contact buttons, preferably having curved convex outer surfaces, such that a uniform contact of the bottom with the heating element is achieved each time the wrapped bundle is indexed and reciprocated.

In a preferred embodiment, a heat activated adhesive is pre-applied to the packaging stock and forced cooling sets the activated adhesive. For example, in the modified GDX-1 embodiment, the bottom flaps may be cooled in a cooling zone comprising 75° of the arcuate path of the activation turret. Each wrapped bundle contacts a cooling element in the cooling zone in the conventional reciprocating indexed fashion. The cooling element may be constructed similarly to the heating element, having a plurality of contact buttons; the difference being that the cooling element is set at a temperature below the adhesive activation temperature. Next, the wrapped bundles are removed from the activation turret, a closure stamp may be applied and the wrapped bundles are transferred to an exit ramp apparatus in the conventional fashion. The exit ramp apparatus preferably is split into heating and cooling zones thereby affecting the activation and setting of the sideseam binder. The exit ramp apparatus also is modified such that when the packing machine is turned off, it continues processing packs that are on the exit ramp apparatus at shut down such that all of the packs are processed and transferred from the machine. Likewise, the heater associated with the activation turret may be withdrawn from contact with bundles in order to minimize heat degradation.

An advantage of the present invention is that glue application apparatus, such as glue dauber assemblies, glue rollers, scraper assemblies, glue pots, glue fill assemblies and glue pot sensors can be eliminated from cigarette packaging machines, thus making the machines less costly, simpler, easier to maintain and less prone to failure.

A further advantage of the present invention is that a pre-applied adhesive, which is substantially non-tacky after it is applied and until activated, may be used rather than wet glue. Use of such a substantially non-tacky pre-applied adhesive eliminates the problem of clogging that occurs in wet-glue machines, thus decreasing maintenance costs, dirt accumulation and machine downtime.

A still further advantage is that the adhesives can be pre-applied. Another advantage is greater flexibility in positioning the adhesive because the limitations inherent in wet glue application systems are eliminated. An additional advantage is that a stronger seal can be achieved because a larger area can be covered by the pre-applied adhesive. Yet another advantage is that the amount of adhesive applied is decreased because pre-applied adhesives can be coated in thinner layers than wet glue. Still another advantage is that more consistent results can be obtained by using a pre-applied adhesive.

Still another advantage of the present invention is that slippage is decreased and speed of operation therefore can be increased. An additional advantage of the present invention is that smearing of adhesive is avoided and all but eliminated.

A further advantage of the present invention is that fewer packs are damaged due to machine stoppages because the exit ramp apparatus continues to operate when the packer is stopped, the maintenance problems associated with the use and handling of wet glue, such as clogging and resupply of glue, are eliminated and the problem of wet glue drying out during machine stoppages is eliminated.

Yet another advantage of the present invention is greater flexibility in designing guides and other handling apparatus because there is no need to avoid the glue daubers or to avoid handling the adhesive side of the packaging stock.

Another advantage of the present invention is that the cigarette packs are less pervious to water because tighter seals can be achieved and adhesives that are not soluble in water may be used.

A further advantage of the present invention is that wrinkling and scalloping are decreased.

It is therefore an objective of the present invention to provide an apparatus and method for packing cigarettes in packs and boxes using pre-applied adhesive and apparatus for activating and setting the pre-applied adhesive.

BRIEF DESCRIPTION OF THE DRAWINGS

The above and other objects and advantages of the invention will be apparent upon consideration of the following detailed description, taken in conjunction with the accompanying drawings in which like reference characters refer to like parts throughout and in which.

DETAILED DESCRIPTION OF THE INVENTION

Figure 1:
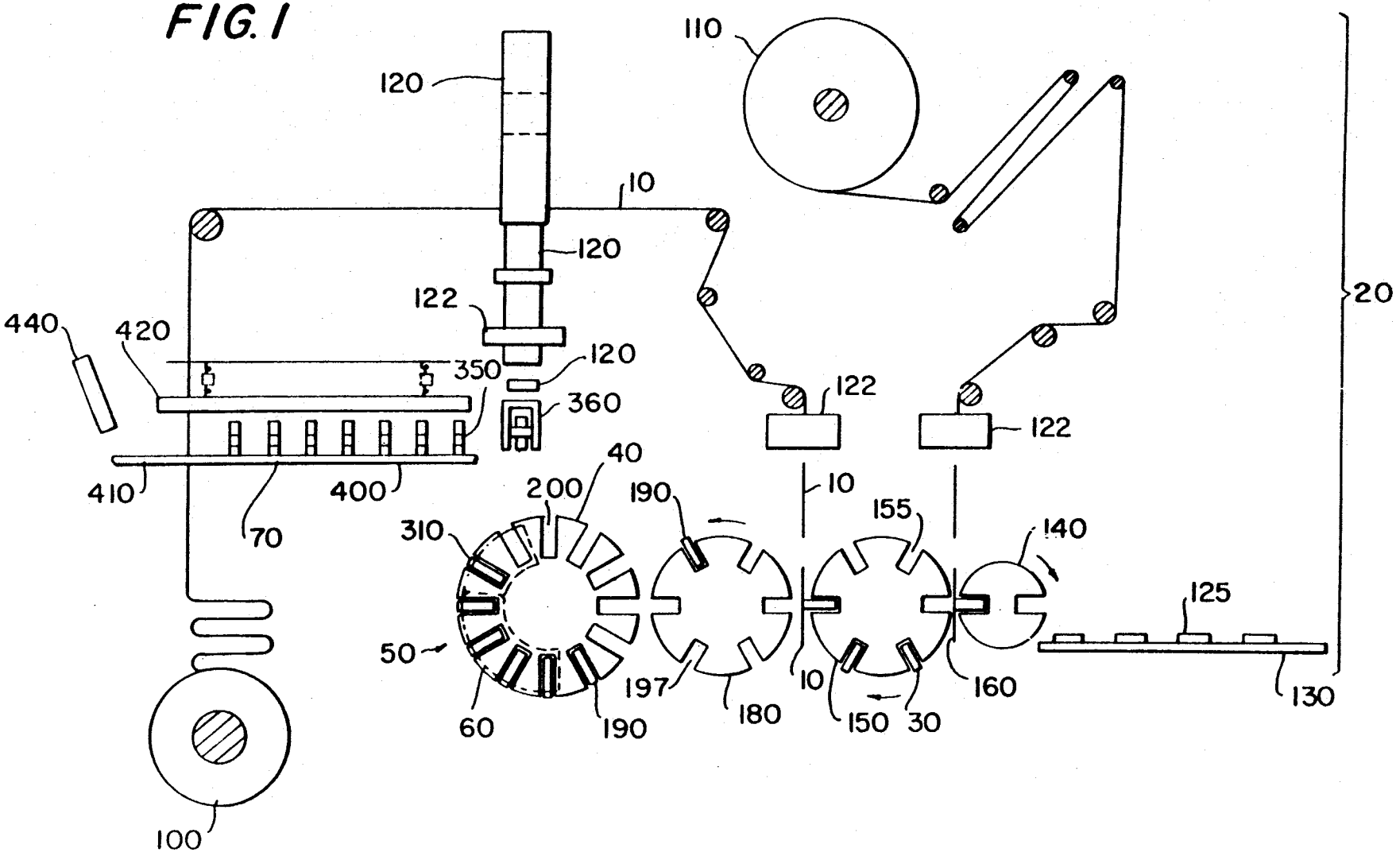
FIG. 1 is a side elevation of a pre-applied adhesive packing machine according to the present invention.
Figure 2:
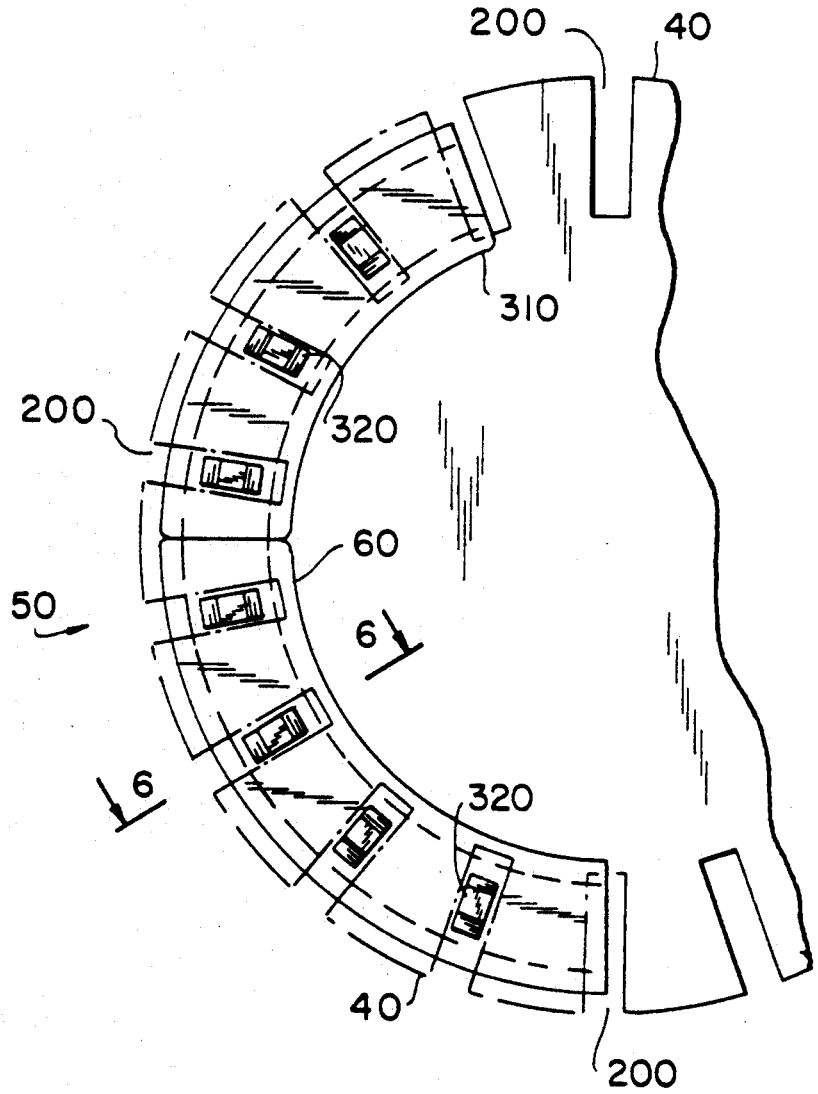
FIG. 2 is a side elevation of heating and cooling elements of a pre-applied adhesive packing machine according to the present invention.

A sealed cigarette pack is formed by activating a pre-applied adhesive and then setting the adhesive. In one embodiment of the preferred modified turret-type packing machine embodiment, a heat activated adhesive is pre-applied to cigarette pack labels 10, the labels are then supplied to the processing apparatus of the packing machine 20 and are wrapped around bundles of foil-wrapped cigarettes 30. The ends of each label are then folded to form the bottom of a cigarette pack at the activation turret 40 of the packing machine 20. The adhesive is activated as it enters an activating zone 50, which comprises an a portion of the arc covered by the activation turret, such as about 60° to 180°. In the activating zone, the bottom of each label-wrapped bundle contacts a heater 60 in the reciprocating indexed fashion described below, thereby activating the adhesive. The activated adhesive is set, either by passive or forced cooling, as discussed more fully below. The label-wrapped bundle then is transferred to an exit ramp 70 that incorporates a heating apparatus 400 which activates the sideseam adhesive in conjunction with pressure applied by a patter plate 420.

Any type of adhesive that can be pre-applied to packaging stock and activated in a packaging machine may be used. Among the possible adhesives are those which can be activated by heat, lasers, ultrasonic waves, infrared radiation, friction, or heated air. In the preferred embodiment, heat activated adhesives are used. Preferably, the activation temperature is above typical ambient temperatures so that the adhesive is not activated in normal handling or storage conditions. For example, many of the known emulsion heat seals, hot melts or solvent-based adhesives may be used, such as ethylene vinyl acetate copolymers, acrylics, polyolefin copolymers and ionomers. It is preferred that the adhesive be capable of forming a positive seal within 0.1–0.2 seconds at heater temperatures of approximately 100°–160° C. and at pressures between 1 and 30 psi. It also is preferred that, if pre-cut or stacked labels are used, the adhesive coating be resistant to blocking when the labels are stacked. One suitable heat activated adhesive is No. 4408-01A by Findley Adhesives, Inc., 11320 Watertown Plank Road, Wauwatosa, Wis. 53226-3413, which typically activates at temperatures as low as 90° C.

Figure 3:
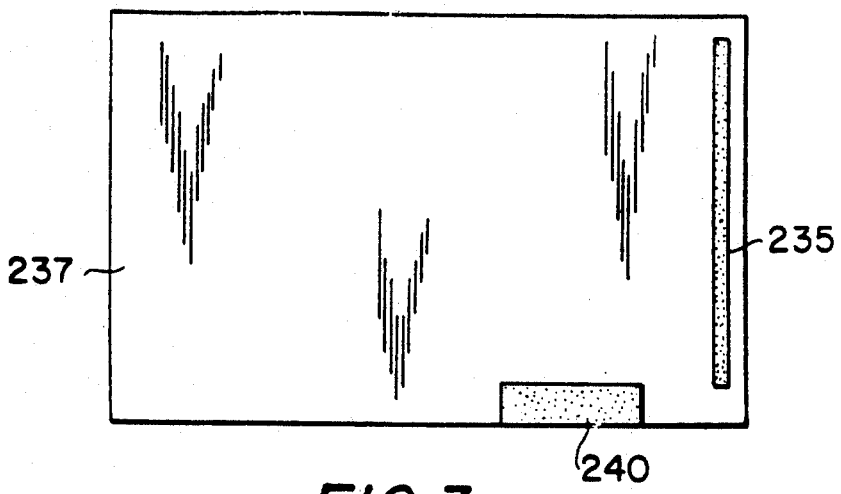
FIG. 3 is a front view of a soft pack label that is coated with pre-applied adhesive for use in conjunction with a pre-applied adhesive packing machine according to the present invention.
Figure 4:
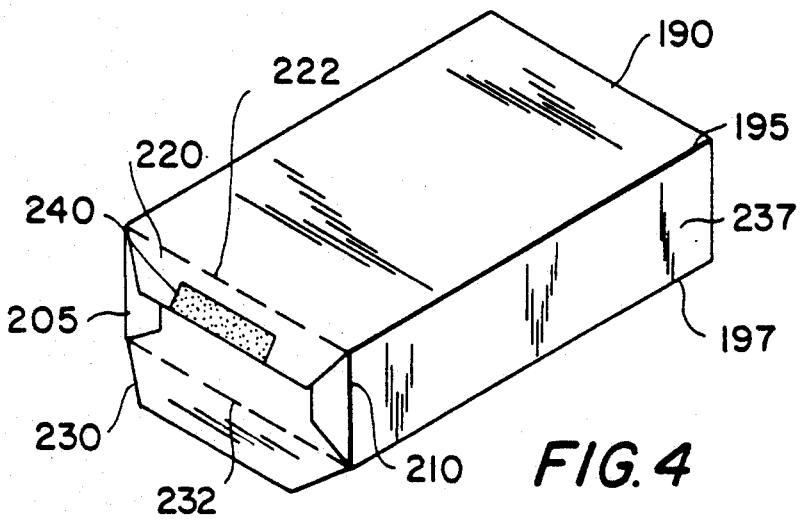
FIG. 4 is a perspective of a label wrapped cigarette bundle showing two of the four folds on the bottom of the bundle.

The adhesive is pre-applied to the stock through any process of applying adhesives. In the preferred embodiment, the adhesive is printed using a gravure process and apparatus. In such a gravure process, a print roll is constructed with a pattern of cells corresponding to the position of the adhesive strips that are to be applied to the stock. Adhesive strips are positioned such that when cigarette packages using the printed stock are assembled, seals are formed at the locations desired. FIG. 3 illustrates an example of the placement of adhesive strips 237, 240 on a soft cigarette pack label 10. In operation, an adhesive is applied to a portion of the print roll such that it fills the cells. Stock contacts the roll such that an amount of the adhesive that is in the cells transfers to the stock. The adhesive is dried and the stock either is accumulated on rolls or is cut and stacked. Alternative adhesive application methods, such as flexography, offset printing and stamping also may be used.

Any method and processing apparatus that forms label wrapped cigarette bundles may be used in conjunction with the present invention. In the preferred embodiment, a turret-type cigarette packer is used for bundling cigarettes and wrapping them in liners (typically foil coated paper liners) and labels. For example, U.S. Pat. Nos. 3,628,309 and 3,948,115, discussed hereinabove, disclose applicable methods and apparatus. The GDX-1 packer from G. D. Societa per Azioni is preferred. In the modified GDX-1 packer embodiment, illustrated in FIG. 1, apparatus is provided for mounting spools of labels 100, liner 110 and closure stamps 120, which are components necessary for the manufacture of soft cigarette packs. Cutting apparatus 122 is provided to cut each of those components to the size desired for forming packs. The size of the cut components can be varied, depending on the size of the pack to be fabricated. For example, a typical 20 cigarette pack containing 84 mm. filter tipped cigarettes requires a 24 sq. in. label, 26.4 sq. in. foil coated liner and 1.3 sq. in. closure stamp. It is noted that smaller packs generally require smaller cut components and larger packs generally require larger cut components. Alternatively, pre-cut labels or closure stamps may be supplied, in which case, apparatus is provided for storing stacks and sequentially removing labels or closure stamps from the stacks and inserting them into the processing apparatus.

The modified GDX-1 packer of the preferred embodiment additionally comprises four processing turrets. Cigarettes are assembled in bundles 125 and transported on a transfer belt 130 to the first processing turret 140. Preferably, each bundle contains the number of cigarettes that are to be included in each pack. The first turret 140 transfers the bundles from the transfer belt 130 to the second processing turret 150. As each cigarette bundle 125 is transferred from the first turret 140 to the second turret, the bundle laterally impinges upon a cut foil liner 160, which is positioned to intersect and fold around a side of the bundle 125 as the bundle is transferred, forming a foil-wrapped bundle 30.

The second processing turret 150 and apparatus associated with it folds both ends of the foil liner 160 around the bundle 125 as the bundle moves in a pocket 155 on the turret 150. The foil-wrapped bundle 30 then is transferred from the second processing turret 150 to the third processing turret 180. As each foil-wrapped bundle 30 is transferred it laterally impinges upon a cut label blank 10, which is positioned to intersect and fold around a side of the foil-wrapped bundle 30 as the bundle is transferred.

In the GDX-1 packer, and in other wet-glue packers including both turret-type and mandrel-type packers, the cut label blank 10 is coated at desired locations with a wet glue. Accordingly, those systems incorporate glue application apparatus, including for example, a glue dauber assembly, glue roller, scraper assembly, glue pot, glue fill assembly and glue pot sensor, which apply the wet glue to labels before they are inserted between the second and third processing turrets 150, 180 and wrapped around the foil-wrapped bundles 30. None of these glue application apparatus are required or desired in the present invention. In the preferred modified GDX-1 packer, the glue application apparatus are removed.

The third processing turret 180 of the GDX-1 based embodiment, and apparatus associated with it, operates to make a side fold 195 on the label 10 and two of the four bottom folds 205, 210 to form a label-wrapped bundle 190 as the bundle moves in a pocket 197 on the turret 180 around approximately 180° of the rotation of the turret. Each label-wrapped bundle 190 is then transferred from the third processing turret 180 to the fourth processing turret 40. A second side fold 197 is made as the label-wrapped bundle 190 is transferred. In the present invention, this fourth processing turret 40 is known as the activation turret 40.

The activation turret 40 and apparatus associated with it, operates to make the third and fourth bottom folds on label 10 before each label-wrapped bundle 190 enters the activating zone 50. Each label-wrapped bundle 190 has two bottom tabs 220, 230, which are folded on the activation turret 40. The first bottom tab 220 preferably has a pre-applied adhesive 240 coated on its outer surface. In the activation turret 40, the first bottom tab 220 is folded first and then the second bottom tab 230 is folded such that a portion of the underside of the second tab 230 contacts at least the pre-applied adhesive coated portion of the first tab 220. The label-wrapped bundle 190 also has two side tabs 235, 237. The side tabs preferably are folded in the third processing turret 180 and during transfer to the activation turret 40, respectively. The first side tab 235 preferably has adhesive applied on a portion of its outer surface. When the second side tab 237 is folded a portion of its underside contacts the outer surface of the first side tab 235 such that at least the portion of the first side tab 235 having adhesive applied on it is aligned with the second side tab 237.

Figure 5:
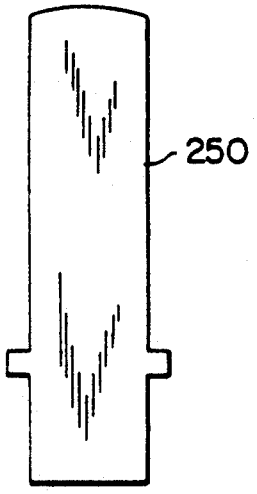
FIG. 5 is an insertion finger according to the present invention.
Figure 6:
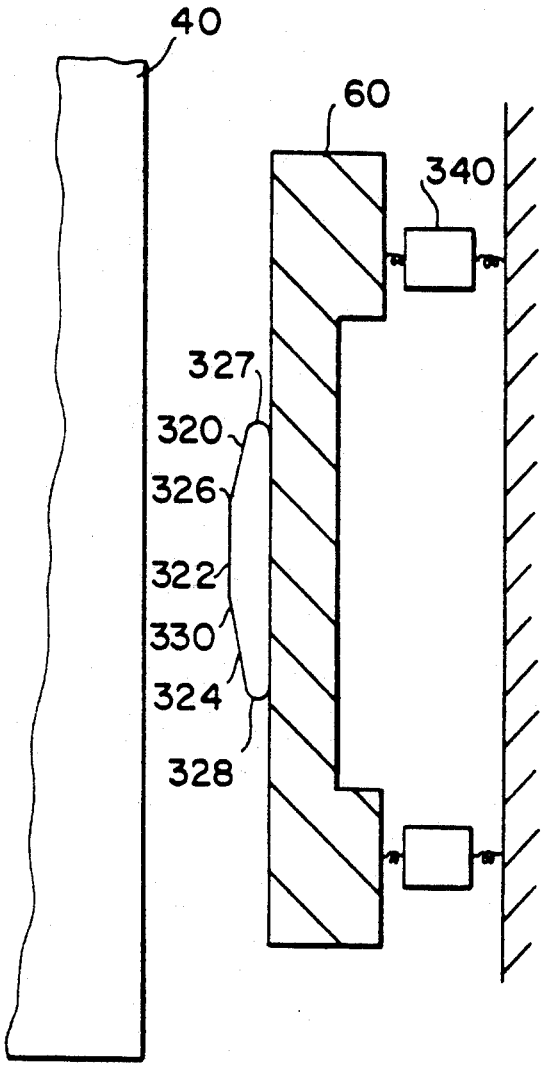
FIG. 6 is a cross-section the heating element of FIG. 2 taken from line 6—6 of FIG. 2.

Each label-wrapped bundle 190 nests in a pocket 200 on the activation turret 40. Among the apparatus associated with the activation turret is an leaf spring insertion finger 250. The insertion finger 250 is inserted before the third and fourth folds are made such that the insertion finger is situated between the two tabs 220, 230. The finger normally used in the GDX-1 packer is wider at the bottom than at the top. This can cause the bottom of the label-wrapped bundle to splay open at the third and fourth folds. Alternatively, a Louisville finger 250, depicted in FIG. 5, is used. The Louisville finger has straight side walls and is less likely to cause the bottom to splay open.

In operation of this modified GDX-1 embodiment, an insertion finger is positioned between tabs 220 and 230 after the label-wrapped bundle 190 is transferred to the activation turret 40. The third fold 222 is made as the first tab 220 is folded over the insertion finger 250. Then the fourth fold 232 is made as the second tab 230 is folded over the opposite side of the insertion finger 250 such that the inner surface of the second tab 230 covers the pre-applied adhesive portion 240 of the outer surface of the first tab 220.

After the third and fourth bottom folds 222, 232 are made, the label-wrapped bundle 190, which is still on the activation turret 40, enters the activating zone 50. The activating zone 50 takes up a portion of the arc of rotation of the activation turret, typically about 170°. The activating zone 50 comprises a heater 60, and preferably a cooling element 310. The heating and cooling elements 60, 310 are located adjacent to the activation turret 40 such that the bottoms of label-wrapped bundles 190 in the pockets 200 of the activation turret 40 are facially exposed to the heating and cooling elements 60, 310.

The activation turret 40 of turret-type embodiments of the present invention moves in an indexing motion such that it rotates a predetermined amount and then stops at the index positions. At each stop in the activating zone 50, apparatus associated with the activation turret 40 causes bundles 190 in the pockets 200 to reciprocate such that they are caused to move a linear distance axially in the direction of their bottom ends. The heating and cooling elements 60, 310 are constructed and mounted such that the bottom of each label-wrapped bundle 190 in a pocket 200 contacts one of them as it is caused to reciprocate at each index stop corresponding to contact areas of the heating and cooling elements 60, 310. As the contact is made, heat is transferred from the heater 60 to the bundles 190, thereby activating the pre-applied adhesive.

The heater 60 is heated by any heat source, such as electricity, steam or gas. Preferably, electricity is used. The temperature of the heater 60 is set such that the pre-applied adhesive is activated. The temperature selected depends upon the activation temperature of the adhesive used, the heat transfer characteristics of the pre-applied adhesive coated packaging stock, the operating speed of the machine, the total dwell time (the amount of time in which each pack bottom contacts a heating element) and the pressure applied to the seal. The temperature selected is also limited at the upper end by the degradation temperatures of other components of the packaging stock, such as ink and varnish coatings. In the GDX-1 turret-type embodiment, pressure is applied by the opposing forces exerted by the insertion finger 250 on the inside surfaces of the bottom tabs 220, 230 and the heater on the outer surfaces of those tabs. In the preferred embodiment the Findley No. 4408-01A adhesive is activated by setting the heater to 130°–150° C., with a total dwell time of 0.4–1.0 seconds and a pressure sufficient to affect a seal.

Acceptable seals can be achieved with the present invention without the use of forced cooling, which is done with the cooling element 310. However, the proportion of acceptable seals can be increased if forced cooling is used to accelerate setting the adhesive. The cooling element 310 may be set at any temperature below the activation temperature of the adhesive used, preferably such that when the pack leaves the cooler 310, the adhesive is set. If no cooling element is used, then the heater optionally may occupy the entire arc of the activating zone 50. In the preferred embodiment, the heater 60 occupies a 90° arc within the activating zone 50 and the cooling element occupies a 75° arc.

In one embodiment of the present invention, the heater of the GDX-1 packer is used. This GDX-1 heater has a flat raised portion that in operation contacts the label-wrapped bundle 190 bottoms and activates the pre-applied adhesive.

In order to achieve a higher proportion of commercially acceptable seals, however, it is preferred that both the heater 60 and its mounting means be modified from those used in the GDX-1 packer. The preferred heater 60 comprises a number of contact buttons 320, which are located at the index points of the activation turret 40 such that the label-wrapped bundles 190 align with contact buttons 320 at the index points in the activating zone 50. In the modified GDX-1 embodiment, it is preferred that the contact buttons 320 be situated on the heater 60 in 15° increments corresponding to the 15° increments between index points. As the label-wrapped bundles 190 in the pockets 200 are caused to reciprocate, the bottoms of the bundles 190 in the activating zone 50 contact the curved outer surfaces 330 of contact buttons 320.

When a bundle is caused to reciprocate in this embodiment, the insertion finger 250 flexes due to the pressure generated by the opposing action of the insertion finger 250 and the outer surface 330 of the corresponding contact button 320. The amount of flex by the insertion finger 250 varies with the force applied and the stiffness of the insertion finger 250. For example, a relatively rigid insertion finger will flex less than a flexible finger. Each contact button 320 preferably is constructed with a generally curved surface 330 accommodating the expected flex of the insertion finger 250, thereby increasing the area of contact between the bundle bottoms and the contact buttons 320. With a typical GDX-1 insertion finger, a preferred profile of the contact button comprises a flat 5 mm portion 322 in the center and flat 7.5 mm portions 324, 326 on both sides of the center portion 322 which are angled at 0° 45′ with respect to the center portion 322. It is also preferred that the edges 327, 328 of the contact button 320 have radiused edges, preferably 1 mm in radius. Radiused edges 327,328 and the shape provided by surfaces 322, 324, 326 also avoid the imposition of crease lines and smears along the bottom portion of the park. Various coatings, such as stainless steel and ceramics, may be applied to the contact surfaces of the heater 60 in order to facilitate heat transfer and to minimize sticking of the bundle bottoms to the heater 60. Likewise, the heater 60 may be constructed of various materials in order to achieve desireable heat transfer and minimize sticking. Solid stainless steel with a high polish is preferred.

The mounting means of the GDX-1 packer may be used in the modified GDX-1 embodiment to mount the heater 60, regardless of whether the GDX-1 heater or the preferred contact button heater is used. However, alternative mounting means may be used to achieve better results. For example, it has been found that if the length of the mounting bushing 340 is increased from 16 mm, the heater 60 is more stable, rocking is reduced and fewer unacceptable heat seals are generated. In the preferred embodiment, the mounting bushing 340 is 21 mm long. Also in the preferred embodiment, apparatus is included which retracts the heater 60 whenever the machine is stopped. This retraction feature reduces the number of packs lost due to heat degradation at stoppages.

The cooling element 310 may be constructed and mounted the same way that the heater is constructed and mounted. Like the heater 60, the preferred cooling element has spaced contact buttons with convex curved outer surfaces designed to match the expected flex of the index fingers 250 and is mounted on a 21 mm bushing. The temperature of the cooling element 310 is set such that the activated adhesive is set. The temperature selected depends upon the activation temperature, dwell time and pressure applied to the seal.

In the modified GDX-1 embodiment, the label-wrapped bundles 190 generally are removed from the activation turret 40 at the end of the activating zone 50 and a closure stamp 120 is applied at the top end of the bundles 190 to form closure stamp bundles 350. The closure stamp 120 may be applied using the apparatus of the GDX-1 packer 360, which comprises an application fork that places the closure stamp on the bundle as the bundle vertically impinges upon the stamp. Adhesive is used to bind the closure stamp 120 to the bundles. In one embodiment, a wet glue is used, as in known wet-glue machines such as turret-type packers and mandrel-type packers. Alternatively, a pre-applied heat activated adhesive may be used, in which case a heating apparatus is added in order to activate the adhesive.

After the closure stamp is applied, the closure stamped bundles 350 are transferred to an exit apparatus 70. The exit ramp of the GDX-1 packer may be used. Preferably, the exit ramp 70 is modified such that it comprises heating 400 and cooling plates 410 in order to achieve a higher proportion of acceptable seals. The exit ramp may include any conveyancing means to convey the closure stamp bundles 350 from the start to the end of the exit ramp 70, including a conveyor belt or a vibrating conveyor. In one embodiment, the conveyancing apparatus of the GDX-1 packer is used. In that embodiment, rubber belts are positioned such that they are in frictional contact respectively with the top and bottom of the bundles 350. The rubber belts are moved in a conveyor belt-like fashion such that the bundles 350 are caused to move along the exit ramp 70. Alternatively, the heating and cooling plates 400, 410 may be caused to vibrate such that they provide a locomotion of the type generated in vibrating conveyors. In the preferred embodiment, a spring mounted patter plate apparatus 420 is situated above the bundles 350 on the exit ramp 70 such that in operation, the patter plate is lifted and lowered to apply and release pressure in a reciprocating fashion. This preferred mounting mechanism is modified from the GDX-1 mechanism by the addition of spring and damping apparatus to promote a more even application of pressure by the patter plate.

The heat supplied by the heating plate 400 activates the pre-applied adhesive in the sideseams of the closure stamped bundles 350. Heat is supplied to the heating plate 400 by any heat source, such as electricity, steam or gas. Preferably, electricity is used. As with the heater 60 discussed hereinabove, the temperature at which the heating plate 400 is set depends upon the activation temperature of the adhesive used, the heat transfer characteristics of the adhesive coated stock, the operating speed of the machine, the total dwell time and the pressure generated by the patter plate apparatus 420. The temperature selected is also limited at the upper end by the degradation temperatures of other components of the packaging stock, such as ink and varnish coatings. In the preferred embodiment, apparatus is included which causes the exit ramp 70 to continue operating whenever the machine is stopped. This continual operation feature reduces the number of packs lost due to heat degradation at stoppages.

The heating and cooling plate profile may be modified in order to promote activation. For example, a lengthwise corner notch may be cut such that the bottom end of the side of the bundles 350 on the exit ramp 70 do not contact the surface of the heating and cooling plates. This promotes sideseam sealing near the bottom because the contact between the sideseam and the plates is enhanced.

Sensing apparatus 440 may be located at the end of the exit ramp 70 for quality control purposes to detect cigarette packs with defective seals. Defective packs are segregated and stored for recycling or disposal. Properly sealed packs are conveyed away for further processing.

In alternative turret-type embodiments of the present invention, the pre-applied adhesive is activated at other locations on the packing machine. For example, the sideseam may be activated on the third turret 180 by locating an arcuate heated mandrel over the top of the third turret 180 such that it activates the sideseam adhesive. The arcuate heated mandrel may reciprocate with each index step of the third turret 180 such that when the turret comes to the momentary stationary location associated with each index step, the arcuate heated mandrel reciprocates such that at the stationary index position, it contacts the sideseams of the bundles 190 in the pockets 197 of the turret 180 and is withdrawn before the turret 180 rotates to the next index position.

In a further alternative turret-type embodiment the bottoms are activated on the exit ramp 70 instead of on the fourth turret 40. In this embodiment, a heated belt is included on the exit ramp 70, such that it contacts the bottoms of the bundles 350 on the exit ramp 70 such that the adhesive on the bottoms is activated by heat absorbed from the heated belt.

Other embodiments of the present invention are directed to cigarette packaging machines beyond soft cigarette packers. For example, in one alternative embodiment, hard cigarette packs (commonly referred to as FLIP-TOP ® boxes or hinged-lid packs) are manufactured. As with cigarette labels of the preferred embodiment, an adhesive is pre-applied to the hard pack blanks. These pack blanks coated with pre-applied adhesive are supplied to a packing machine. The hard pack packing machine of this embodiment does not require apparatus for applying wet glue to the pack blanks, and has apparatus for activating the pre-applied adhesive. In one embodiment, heat may be used as the activation vector, although other means of activation (such as ultrasonics, conduction, lasers, infra-red radiation, and friction) may be used depending upon the adhesive used and the characteristics of the hard pack blanks. An alternative embodiment includes cooling apparatus to cool and thereby set the seals. In one type of hard packer, cigarette bundles are formed; each bundle is wrapped with a liner material (preferably foil coated paper); an innerframe and a pack blank are wrapped around each liner-wrapped bundle and the requisite folds are made; and, heat and pressure are applied at the bottom, side and top flaps in order to activate the pre-applied adhesive.

In another alternative embodiment of the present invention, cigarette pack cartons are manufactured. The cigarette packs may be fabricated using any method or apparatus, including the method and apparatus of the present invention. As with cigarette labels of the preferred embodiment, a heat activated adhesive is pre-applied to the cartons. Then, these cartons with pre-applied adhesive are supplied to a boxing machine. The boxing machine of this embodiment does not require apparatus for applying wet glue to cartons. In one embodiment, heat may be used for activation, although other means of activation may be used. If heat activated adhesives are used, cooling apparatus may be included to help set the seals.

Thus, it is seen that an apparatus and method for manufacturing cigarette soft packs, hard packs and cartons using pre-applied adhesives is provided. One skilled in the art will appreciate that the present invention can be practiced by other than the preferred embodiments which are presented for purposes of illustration and not of limitation, and the present invention is limited only by the claims which follow.

What is claimed is:

1. A method for manufacturing cigarette packs using a cigarette packing machine that comprises processing apparatus for forming cigarette packs using packaging stock, said stock comprising a pre-applied adhesive, comprising the steps of:

feeding the stock into the processing apparatus of the cigarette packing machine;

feeding a plurality of cigarettes into the processing apparatus of the cigarette packing machine;

forming a plurality of stock-wrapped bundles of cigarettes, wherein each of said stock wrapped bundles comprise cigarettes which are wrapped with the packaging stock;

activating the pre-applied adhesive of each of the stock-wrapped bundles by causing each of the stock-wrapped bundles to be sequentially contacted with a plurality of activation surfaces;

setting the adhesive by causing a portion of the stock-wrapped bundles to contact a cooling element, said cooling element comprises a plurality of contact buttons.

2. The method of claim 1 wherein:

each of said stock-wrapped bundles comprises a bottom; and said portion of the stock-wrapped bundles comprises the bottoms of the stock-wrapped bundles.

3. Apparatus for manufacturing cigarette packs, said cigarette packs comprising packaging stock that comprises a pre-applied adhesive, comprising:

feeding means for transporting the packaging stock along a feed path means;

assembling means for gathering a plurality of cigarettes that are to be included in each said cigarette packs;

bundling means for forming a plurality of stock-wrapped bundles located downstream of the feeding and assembling means wherein the plurality of cigarettes provided by the assembling means are wrapped with the packaging stock provided by the feeding means;

a plurality off activation surfaces for activating the adhesive that is pre-applied on the packaging stock of the stock-wrapped bundles, said plurality of activation surfaces being arranged in series; and setting means for setting the adhesive, said setting means being located downstream of said activation surfaces, and wherein said setting means comprises:

a cooling element that comprises contact buttons; and means for causing a portion of the stock-wrapped bundles to contact said cooling element comprising indexing means.

4. The apparatus of claim 3 wherein:

each of said stock-wrapped bundles comprises a bottom; and said portion of the stock-wrapped bundles comprises the bottoms of the stock-wrapped bundles.

5. Apparatus for manufacturing cigarette packs, said cigarette packs comprises packaging stock that comprises a pre-applied adhesive, comprising:

feeding means for transporting the packaging stock along a feed path means;

assembling means for gathering a plurality of cigarettes that are to be included in each of said cigarette packs;

bundling means for forming a plurality of stock-wrapped bundles located downstream of the feeding and assembling means wherein the plurality of cigarettes provided by the assembling means are wrapped with the packaging stock provided by the feeding means; and wherein each of said stock-wrapped bundles comprises a bottom a plurality of activation surfaces for activating the adhesive that is pre-applied on the packaging stock of the stock-wrapped bundles, said plurality of activation surfaces being arranged in series;

a setting means for setting the pre-applied adhesive operatably downstream of said plurality of activation surfaces; wherein said apparatus for manufacturing cigarettes is a turret-type cigarette packing machine further comprising:

a plurality of processing turrets, said processing turrets comprising at least one activation turret, said activation turret comprising a plurality of pockets and said activating turret being operatably mounted adjacent to said plurality of activation surfaces and to said setting means; and an exit apparatus means that is situated downstream of said activation turret;

and wherein said setting means comprises means for cooling the bottom of each of said stock-wrapped bundles when each is in a pocket on the activation turret by causing the bottom to contact a cooling element.

6. The apparatus of claim 5 wherein:

said activation surfaces comprise a heater means situated in proximity to said activation turret such that said heater means applies heat to the bottom of each of said stock-wrapped bundles when each is in a pocket on said activation turret;

said activation surfaces further comprise a reciprocating means for causing the bottom of each stock wrapped bundle to contact the heater means;

said bottom of each stock-wrapped bundle comprises a plurality of bottom tabs comprising a first bottom tab and a second bottom tab said tabs protruding outwardly from said bottom;

said activation turret further comprises:

a plurality of insertion finger each of said insertion fingers being associated with one of said pockets and being adapted to be inserted between said first and second bottom tabs of a stock-wrapped bundle that is situated within one of said pockets;

folding means for folding said bottom tabs of each of said stock-wrapped bundles situated within one of said pockets over the insertion finger associated with that pocket; and an activation zone comprising the portion of said activation turret that is adjacent to said plurality of activation surfaces; and wherein:

said heater means comprises contact buttons, each of said contact buttons being positions on said heater means such that the bottom of each of said stock-wrapped bundles contacts a contact button in said activation zone; and each of said contact buttons comprises a generally curved outer surface that is constructed with a curved surface, the shape of said curved outer surface corresponding to the flex of an insertion finger; wherein said setting means is situated in proximity to said activation turret such that it assists in setting the activated adhesive on the bottom of each of said stock-wrapped bundles when said stock-wrapped bundle is in a pocket on said activation turret.

7. The apparatus of claim 6 wherein:

said activation zone further comprises a setting zone correspond to the portion of said activation turret that adjacent to said setting surfaces;

said setting surfaces comprise setting contact buttons, each of said setting contact buttons being positioned the bottom of each stock-wrapped bundle contacts a setting contact button in said setting zone; and each of said contact buttons comprises an outer surface that is constructed with a curved surface, the shape of said curved surface corresponding to the flex of an insertion finger.

8. A method for manufacturing cigarette packs using packaging stock, said packaging stock comprising an inside surface and an outside surface, said method comprising the steps of:

pre-applying a dry heat-activated adhesive to a relatively small portion of said outside surface of said packaging stock;

forming a plurality of stock-wrapped bundles of cigarettes, wherein each of said stock-wrapped bundles comprise cigarettes, said cigarettes being wrapped with said packaging stock such that the inside surface of said packaging stock is adjacent to said cigarettes;

activating the pre-applied dry heat-activated adhesive of each of the stock-wrapped bundles by sequentially contacting each of the stock-wrapped bundles with a plurality of heating surfaces; and setting the pre-applied dry heat-activated adhesive of each of the stock-wrapped bundles after said activating step by sequentially contacting each of the stock-wrapped bundles with a plurality of cooling surfaces.

9. The method of claim 8 wherein:

said activating step comprises sequentially contacting each of the stock-wrapped bundles with said plurality of heating surfaces by causing said heating surfaces to be moved closer to said stock-wrapped bundles whereby a plurality of said stock-wrapped bundles contacts a plurality of said heating surfaces; and said setting step comprises sequentially contacting each of the stock-wrapped bundles with said plurality of cooling surfaces by causing said cooling surfaces to be moved closer to said stock-wrapped bundles whereby a plurality of said stock-wrapped bundles contacts a plurality of said cooling surfaces.

10. Apparatus for manufacturing cigarette packs, said cigarette packs comprising packaging stock, said packaging stock comprising an inside surface, an outside surface and a pre-applied dry heat-activated adhesive coated on a portion of said outside surface, said apparatus for manufacturing cigarette packs comprising:

means for forming a plurality of stock-wrapped bundles of cigarettes, wherein each of said stock-wrapped bundles comprise cigarettes, said cigarettes being wrapped with said packaging stock such that the inside surface of said packaging stock is adjacent to said cigarettes;

means for activating the pre-applied dry heat-activated adhesive of each of the stock-wrapped bundles by sequentially contacting each of the stock-wrapped bundles with a plurality of heating surfaces; and means for setting the pre-applied dry heat-activated adhesive of each of the stock-wrapped bundles after said adhesive has been activated, by sequentially contacting each of the stock-wrapped bundles with a plurality of cooling surfaces.

* * * * *